United States Patent [19]

Holden

[11] Patent Number: 4,471,725

[45] Date of Patent: Sep. 18, 1984

[54] HEAT EXCHANGER CLEANER

[76] Inventor: William J. Holden, The Old Rectory, Suckley, Worcestershire, England

[21] Appl. No.: 515,100

[22] Filed: Jul. 19, 1983

[30] Foreign Application Priority Data

Jul. 20, 1982 [GB] United Kingdom ..... 8220958

[51] Int. Cl.[3] ..... F22B 37/18; F22B 37/48

[52] U.S. Cl. ..... 122/379; 122/44 A; 122/155 A; 165/95

[58] Field of Search ..... 122/379, 380, 155 A, 122/44 A; 165/95

[56] References Cited

U.S. PATENT DOCUMENTS

| | | | |
|---|---|---|---|
| 953,958 | 4/1910 | Kelly | 122/155 A |
| 1,668,577 | 5/1928 | Vecchio | 122/379 X |
| 2,914,039 | 11/1959 | Smith | 122/379 |

FOREIGN PATENT DOCUMENTS

| | | |
|---|---|---|
| 321168 | 10/1929 | United Kingdom . |
| 339806 | 12/1936 | United Kingdom . |
| 608002 | 9/1948 | United Kingdom . |
| 709716 | 6/1954 | United Kingdom . |
| 774299 | 5/1957 | United Kingdom . |
| 1123741 | 8/1968 | United Kingdom . |

*Primary Examiner*—Edward G. Favors

*Attorney, Agent, or Firm*—Roylance, Abrams, Berdo & Goodman

[57] ABSTRACT

A solid fuel boiler has a heat exchanger above the fuel bed, and the heat exchanger is provided with an easily operable cleaner.

The heat exchanger comprises a plurality of vertically disposed tubes within each of which is an elongate means (e.g. a chain) which depends from a support member which can be driven, at will, by a motor in order to cause the elongate means to scrape off or dislodge from the inner surfaces of the tubes any soot or other powdery deposits.

The support member, mounted on eccentric crank mountings, is moved by said motor in an orbital path in a horizontal axis.

Each elongate means has its upper end connected to one end of a swivel device whose other end is connected to the support member; this makes the cleaning pattern random.

Each elongate member comprises turbulence creators to improve heat extraction from air/flue gases.

9 Claims, 8 Drawing Figures

HEAT EXCHANGER CLEANER

This invention relates to a heat exchanger cleaner.

In boilers using solid fuel, even in a pulverized form, there is inevitably deposition of gas-borne dust and other products of combustion, and cleaning these deposits off the surfaces concerned is a dirty and unpleasant job which ideally should be done weekly. If the boiler heat exchanger has vertically extending flues through which the products of combustion are intended to travel, cleaning is impossible.

The principal object of the present invention is to facilitate cleaning of the vertical heat exchanger of a solid fuel boiler.

According to a first aspect, therefore, the present invention consists in a solid fuel boiler having a heat exchanger which comprises vertically disposed tubes through which hot air and the products of combustion are intended to pass; elongate means inside and extending lengthways of each of said tubes; and drive means connected to all of said elongate means and operable to cause said elongate means to displace whatever loose deposits are on the surfaces of said tubes.

Said drive means could be manually powered but it will be preferred for said drive means to include an electric motor.

Said drive means, however powered, may be connected to a support member to which corresponding ends of the several elongate means are attached. In a preferred embodiment, said support member is placed above the upper ends of said tubes and the several elongate means depend therefrom into and along said tubes.

A subsidiary object of the present invention is to impart a certain degree of turbulence to the hot air and flue gases as they pass along said tubes; it will be realised that said air/flue gases will not be caused to give up as much heat as possible if they are simply allowed to travel along a straight-flow-path through said tubes.

In order to attain said subsidiary object, each of said several elongate means may be a chain which hangs downwardly from said support member through the respective one of said tubes, the interconnected links of said chain being such as to cause a degree of turbulence of the ascending air/flue gases such as will assist in the extraction of heat therefrom.

In a generally preferred form of said boiler, each chain is connected to said support member by means of a swivel device which enables the entire chain to rotate or move angularly about its own imaginary longitudinal axis.

The boiler according to the present invention and as hereinbefore described may include a pot type underfeed stoker, a rotatable conveyor screw driven to feed coal along a tube to a retort surmounted by tuyeres which are connected by way of a plenum chamber to forced-draught means which supply primary air to said retort, and a device by means of which secondary air is directed onto the fuel bed (which is supported by said retort) from above. Said device may take the form of or may be included in a so-called reflective arch; in one form, said reflective arch may be a hollow box having holes at or near its periphery so that air supplied to the interior of the box will be blown downwardly onto said fuel bed, at least a part of the underside of said hollow box being clad by refractory material which reflects heat downwardly onto the fuel bed, thereby improving combustion.

In accordance with another important but optional feature of the invention, some or all of said chains could be long enough to make contact with and thus to clean other parts of the boiler below the level of the lower ends of said tubes; such other parts may include the top of the reflective arch referred to in the preceding paragraph.

The drive means will preferably cause the elongate means to describe a circular orbit within the respective one of said tubes. Said orbital movement may be obtained by the use of appropriately placed cranks (eccentrics).

One embodiment, by way of example only, will now be described briefly with reference to the accompanying drawings in which there are various views of a solid fuel boiler which incorporates some of the features described and illustrated in published United Kingdom Patent Applications No. 2,093,960A and No. 2,093,585A to which reference can and should be made in order to clarify any points which may not be clear and which do not in themselves form part of the inventive concept underlying the present invention. In said drawings.

Figure 1:
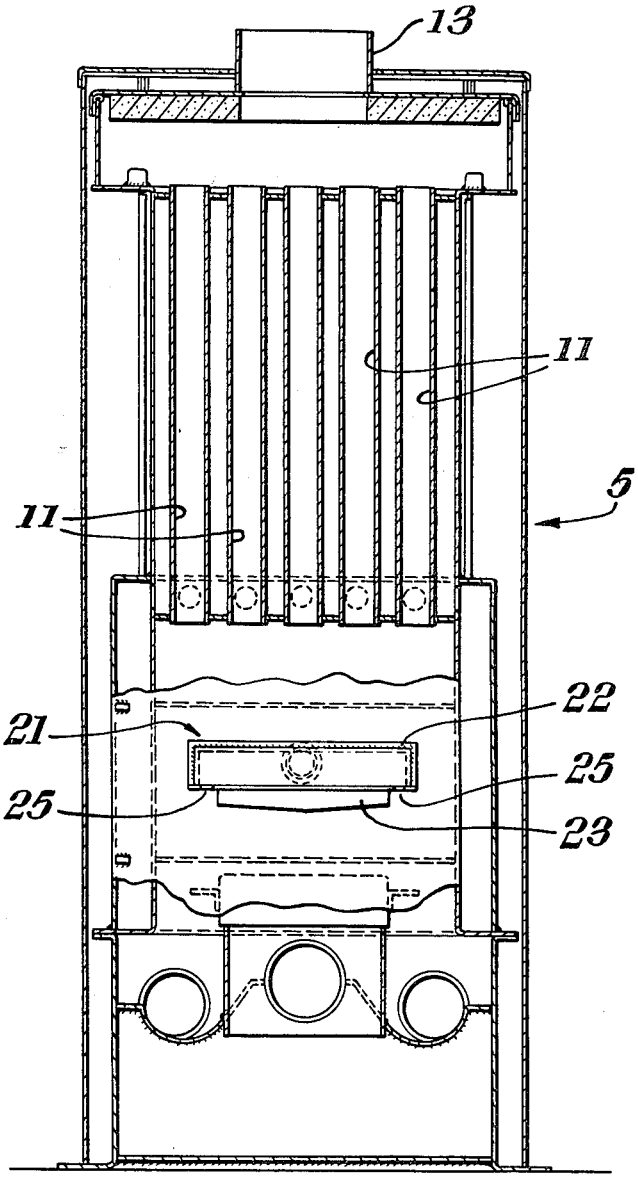
FIG. 1 is a vertical section through a solid fuel boiler according to the present invention, the section having been taken on the line I—I in FIG. 2.
Figure 2:
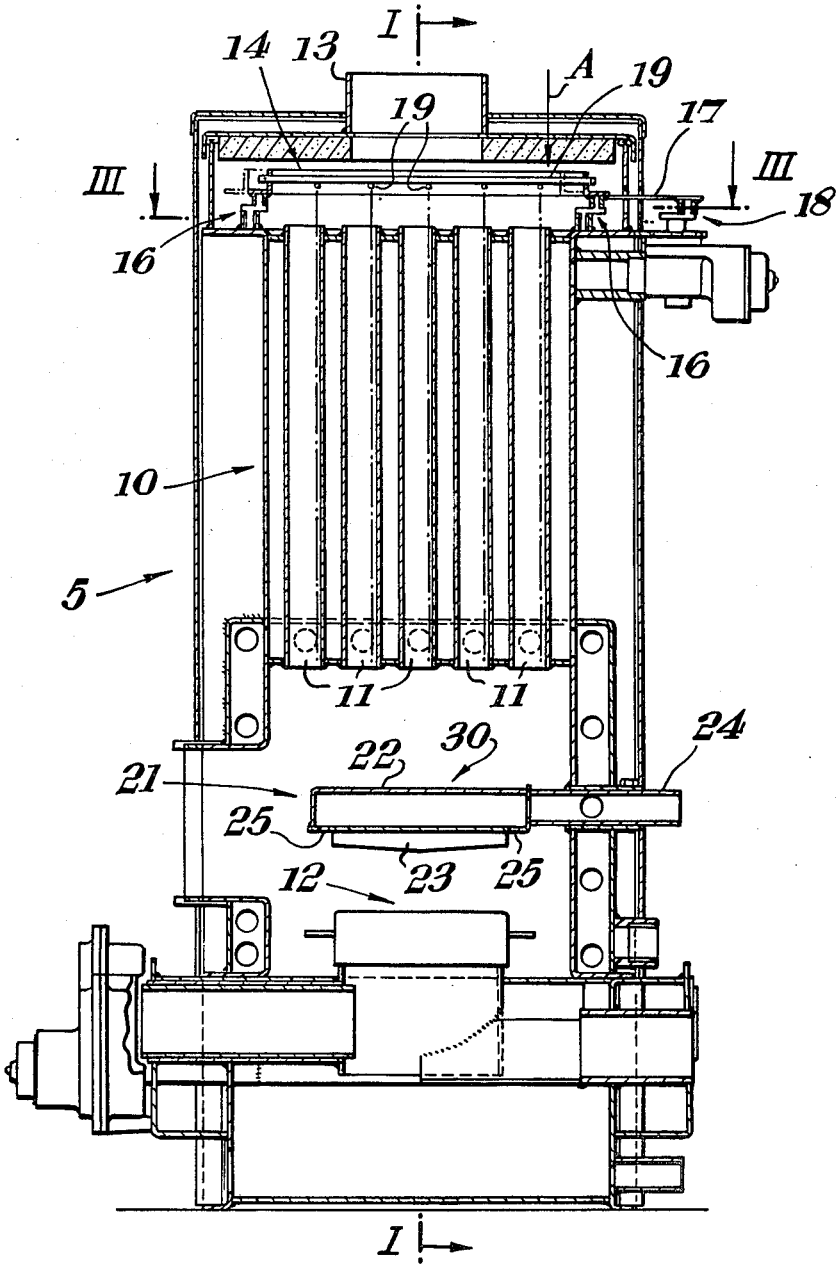
FIG. 2 is another vertical section through said boiler taken on the line II—II in FIG. 3.
Figure 3:
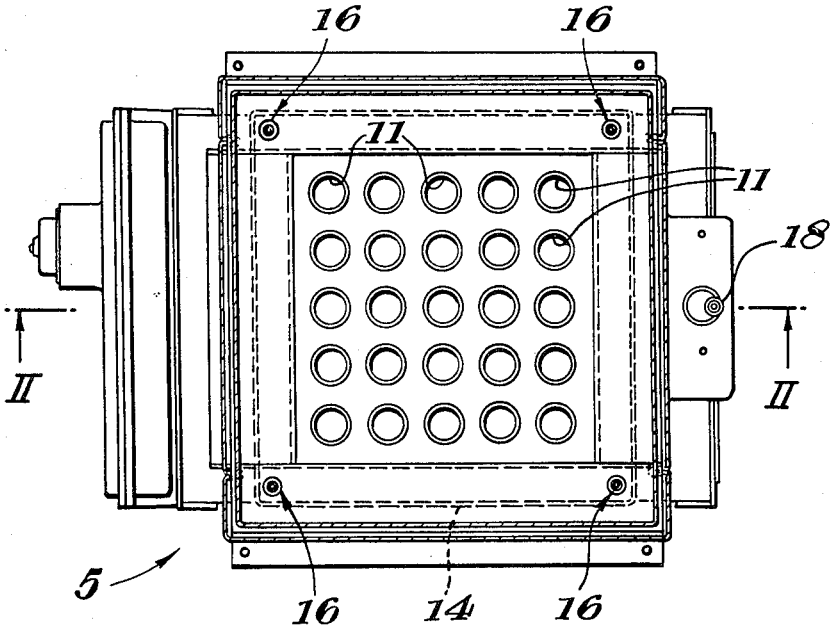
FIG. 3 is a horizontal section through said boiler taken on the line III—III in FIG. 2.
Figure 4:
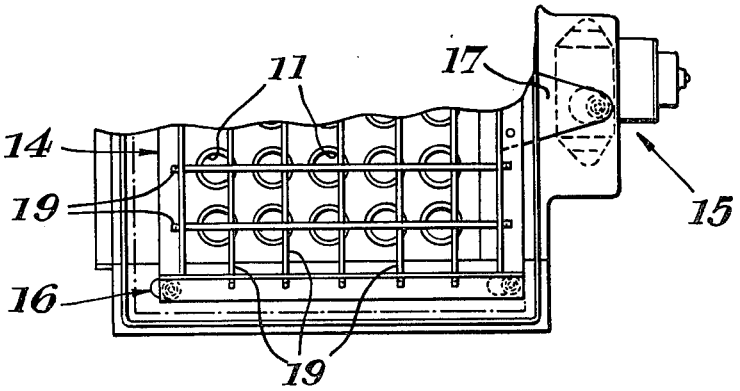
FIG. 4 is a partial view, looking in the direction of the arrow A in FIG. 2, of said boiler with both of its top covers removed.
Figure 5:
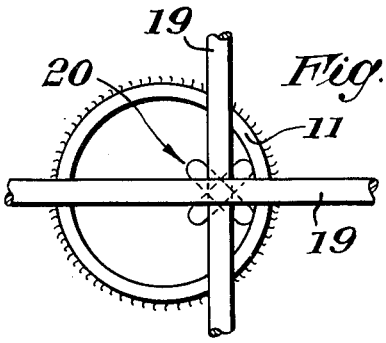
FIG. 5 is a detail view of a chain connected to a support member.
Figure 6:
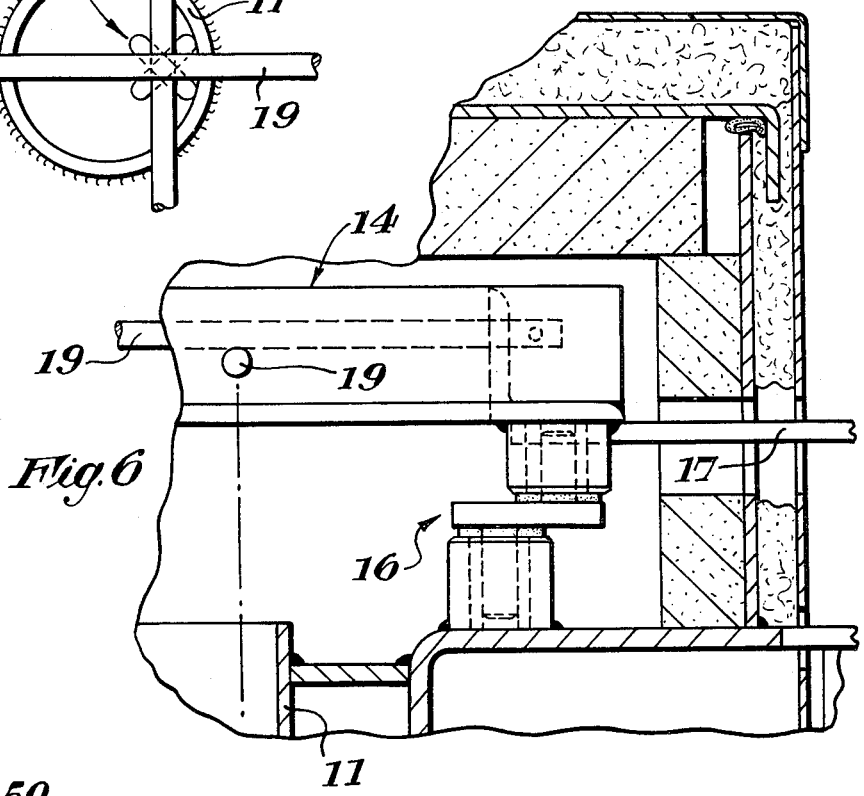
FIG. 6 is a detail view of a part of the drive to the support member.

Referring to the drawings, there is illustrated a boiler 5 which includes a heat exchanger 10 having vertically arranged tubes 11 through which flue gases will pass from the fuel bed (whose position is indicated by the reference numeral 12) to the flue pipe connection 13. It will be seen that there are twenty-five tubes 11 in the particular embodiment illustrated and that a support member indicated generally by the reference numeral 14 is positioned above the upper ends of said tubes. The support member 14 is connected to an electric motor/-gear box assembly 15 and is mounted on four eccentric crank devices 16 (one at each corner), the connection of said member to the motor being by way of a bracket 17 of which one end is fixed to the member 14 (for example, by welding) and of which the other end is engaged by a crank 18 which is driven through said gear box by said motor.

The support member 14 illustrated consists of strips of angle iron welded into a frame which is square in plan. Two sets of parallel rods 19 are connected in any desired and suitable manner (e.g. by welding) to the frame and are so arranged that the rods of one set cross those of the other set. A chain 20 is suspended from each crossing point of the sets of rods 19, thereby providing twenty-five chains in the illustrated embodiment, and it will be seen from the drawings that each crossing point is so placed (relatively to the respective tube 11 beneath the support member 14) that each chain 20 hangs down into a respective one of the tubes 11 and is in contact with the inside surface of said tube over the entire length of said tube. It has been discovered during use of the boiler that it is desirable to connect each chain 20 to the respective crossing point by means of a swivel device 50 (FIGS. 7 and 8) which is well-known in itself and which comprises two closed eyes or rings 51, 52 which are so interconnected at 53 as to be capable of rotation one relatively to the other.

When it is desired to clean the tubes 11, the motor 15 is energised in order to rotate the crank 18. Rotation of the crank 18 causes the entire support member to be moved on its eccentric crank devices 16 in a horizontal plane in an orbital path which is such that each chain 20 moves over the whole (or substantially the whole) of the inside surface of the respective tube 11, with consequent dislodgement of all of the fly ash and soot therefrom.

The boiler illustrated is provided, above the fuel bed 12, with a reflective arch 21 which comprises a hollow box 22 and a block 23 of refractory material attached to the underside of said box. The interior of the box 22 is connectible by a conduit 24 to a forced-draught means (not illustrated) and said draught is directed at the fuel bed 12 through a plurality of apertures 25 around the periphery of said box. The or some of the chains 20 may, if desired, be long enough to contact the upwardly directed surface 30 of the reflective arch and also possibly other surfaces of said arch or of the fire box.

Figure 7:
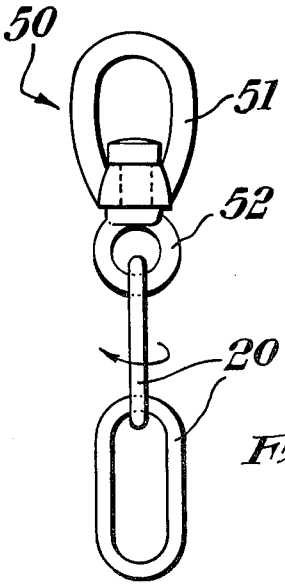
FIGS. 7 and 8 illustrate two different views of a swivel device by means of which a chain is connected to said support member.
Figure 8:
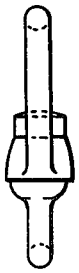

The use of chains 20 as the tube cleaners is considered to be a particularly neat solution of the existing problem because said chains also act as a means for creating turbulence in what would otherwise be a straight-path flow of a hot fluid through the tube concerned. This turbulence enables more heat to be extracted from said hot fluid. It is thought that the very shape or configuration of a chain (whose successive links face in different directions as seen in FIG. 7) will create the necessary degree of turbulence but, if need be, small deflecting plates or other devices (not illustrated) could be added along the length of the chain. Even without a swivel device 50, a chain will achieve a certain level of cleaning but it has been found that a precise and invariable pattern of cleaning is obtained and that said pattern does leave uncleaned portions of the inside surface of the tube concerned. The employment of a swivel device 50 to connect each chain 20 to its respective crossing point has been found to cause each chain to rotate or move angularly about its notional longitudinal axis in a perfectly free manner and randomly; this random rotation-/angular movement has considerably improved the cleaning of the flue.

Another positive feature of the boiler according to the present invention is that the vibration, generated by the support member 14 as it is caused to describe its circular orbit and transmitted by said member to the heat exchanger and other parts by way of said eccentric crank devices 16, helps to loosen fly ash and soot.

It is stated above that the drive means will preferably cause the elongate means to describe a circular orbit within the respective one of said tubes. Of course, as an alternative to such movement, said drive means could rotate each elongate means; such rotation, about the notional longitudinal axis of said elongate means, would cause at least part thereof to become subject to centrifugal force and this would give a good cleaning action.

It is to be understood that the boiler 5 shown in the accompanying drawings has an underfeed pot type stoker, a retort surmounted by tuyeres which are connected to forced-draught means, and a conveyor means by which fuel (e.g. coal) is fed to the retort. Only some of said features are illustrated herein in order to keep the drawings simple, the others being known per se from said published Applications.

I claim:

1. A solid fuel boiler, comprising:

vertically disposed tubes mounted in said boiler to act as a heat exchanger, each of said tubes having upper and lower ends;

a support member positioned above the upper ends of said tubes;

eccentric crank means for mounting said support member;

drive means, connected to said support member, for selectively moving said support member in an orbital path in a horizontal plane on said eccentric crank means;

an elongate means uniquely associated with each of said tubes and having first and second ends;

said first ends of each said elongate means being connected to said support member;

each of said elongate means extending from said first end thereof connected to the support member and into and along an inner surface of the tube with which it is uniquely associated; and each of said elongate means being in contact at all times with a part of the inner surface of the associated tube.

2. A boiler according to claim 1 wherein each of said elongate means comprises a chain of interconnected links, the successive links having attitudes relative to one another such as to cause turbulence in air/flue gases passing along said tubes.

3. A solid fuel boiler, comprising:

a heat exchanger having a plurality of vertically disposed tubes, each of said tubes having upper and lower ends;

a fuel bed in said boiler, the lower ends of said tubes being nearer to said fuel bed than said upper ends of said tubes;

a heat exchanger cleaner having an elongate means positioned within and lengthways of and in contact with each of said tubes, each of said elongate means having first and second ends;

a support member mounted in the boiler above the upper ends of said tubes and movable relative to said tubes in an orbital path in a horizontal plane;

a swivel device coupling the first end of each of said elongate members to said support member permitting relative rotation therebetween; and drive means, coupled to said support member, for moving said support member in the orbital path;

whereby operation of the drive means causes said orbital movement of the support member and the elongate means within all of the tubes to be moved simultaneously over the respective inside surfaces of said tubes in a random manner by said swivel devices.

4. A boiler according to claim 3 wherein a reflective arch is located above said fuel bed and below the lower ends of said tubes, at least some of said elongate means being chains of interconnected links, at least some of said chains extending through the lower ends of the respective tubes and into contact with said reflective arch.

5. A boiler according to claim 3 wherein said elongate means comprise turbulence creator means for causing a degree of turbulence in passing air/flue gases to optimise extraction of heat therefrom.

6. A solid fuel boiler, comprising:

a heat exchanger of vertically disposed tubes for conveying hot air and combustion products, each of said tubes having an inside surface and upper and lower ends;

a support member located above said upper ends of said tubes;

a chain of interconnected links extending inside and lengthways of each of said tubes, each said chain having a first end attached to said support member and hanging downwardly from said support member;

drive means, coupled to said support member, for moving said chains in horizontal orbital paths such that each said chain is in contact at all times with a part of said inside surface of the respective tube.

7. A solid fuel boiler according to claim 6 wherein said chains have transverse dimensions significantly less than transverse internal dimensions of said tubes permitting lateral movement therebetween.

8. A solid fuel boiler according to claim 6 wherein said drive means comprises an electric motor.

9. A solid fuel boiler according to claim 6 wherein said first ends of said chains are connected to said support member by swivel devices permitting relative rotation between said support member and said chains.

* * * * *